US009199469B1

(12) United States Patent
Ito et al.

(10) Patent No.: US 9,199,469 B1
(45) Date of Patent: Dec. 1, 2015

(54) INK JET RECORDING APPARATUS AND MAINTENANCE THEREOF

(71) Applicant: Seiko Epson Corporation, Tokyo (JP)

(72) Inventors: Jun Ito, Shimosuwa-machi (JP); Makoto Nagase, Shiojiri (JP); Kenichiro Kubota, Matsumoto (JP); Naoki Koike, Matsumoto (JP); Shigeki Suzuki, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/711,274

(22) Filed: May 13, 2015

(30) Foreign Application Priority Data

May 13, 2014 (JP) ..... 2014-099325

(51) Int. Cl.
*B41J 2/165* (2006.01)

(52) U.S. Cl.
CPC ..... *B41J 2/16535* (2013.01); *B41J 2/16552* (2013.01)

(58) Field of Classification Search
CPC ..... B41J 2/16552; B41J 2/16535; B41J 2002/1655; B41J 2/17509; B41J 2/1606; C09D 11/38; C09D 11/30
USPC ..... 347/21, 22, 28, 33, 100; 106/31.13
See application file for complete search history.

(56) References Cited

U.S. PATENT DOCUMENTS

| | | | | |
|---|---|---|---|---|
| 8,162,436 | B2 * | 4/2012 | Takahashi et al. | 347/33 |
| 2010/0126529 | A1 | 5/2010 | Seki et al. | |
| 2014/0085376 | A1 * | 3/2014 | Kato et al. | 347/33 |

FOREIGN PATENT DOCUMENTS

| | | | |
|---|---|---|---|
| EP | 2 644 385 | A1 | 10/2013 |
| EP | 2 682 269 | A1 | 1/2014 |
| JP | 2001-260368 | A | 9/2001 |
| JP | 2005-111808 | A | 4/2005 |
| JP | 2009-101630 | A | 5/2009 |
| JP | 2010-274533 | A | 12/2010 |
| JP | 2013-132753 | A | 7/2013 |

* cited by examiner

*Primary Examiner* — An Do
(74) *Attorney, Agent, or Firm* — Nutter McClennen & Fish LLP; John J. Penny, Jr.

(57) ABSTRACT

A maintenance method of an ink jet recording apparatus that performs recording of images on a recording medium using a non-aqueous ink, in which the ink jet recording apparatus includes a nozzle forming surface in which nozzles that discharge the non-aqueous ink are provided; and a wiping member with liquid absorbency, the method including wiping the nozzle forming surface with the wiping member using an impregnating solution, and in which the impregnating solution contains at least one organic solvent selected from a group consisting of compounds represented by the following General Formula (I), esters, and dibasic acid esters.

$$R^1—O—(R^2—O)_n—R^3 \quad (I)$$

(in General Formula (I) shown above, $R^1$ represents a hydrogen atom, an aryl group, or an alkyl group with 1 to 6 carbon atoms, $R^2$ represents an alkylene group with 2 to 4 carbon atoms, $R^3$ represents an aryl group or an alkyl group with 1 to 6 carbon atoms, and n represents an integer of 1 to 9).

18 Claims, 3 Drawing Sheets

INK JET RECORDING APPARATUS AND MAINTENANCE THEREOF

BACKGROUND

1. Technical Field

The present invention relates to a maintenance method of ink jet recording apparatus and an ink jet recording apparatus that executes the method.

2. Related Art

A so-called ink jet recording apparatus that records images and characters using minute ink droplets ejected from nozzles of an ink jet recording head is known in the related art. As the ink used in recording images or the like with such an ink jet recording apparatus, various inks are used, such as aqueous inks in which a coloring material (for example, a pigment) is dissolved or dispersed in a mixture of an organic solvent and water, and non-aqueous inks in which the coloring material is dissolved or dispersed in an organic solvent.

Among such inks, non-aqueous inks are widely used for the feature of being able to record images with excellent drying properties and waterproofness with respect to a recording medium with low absorbency of ink (for example, a vinyl chloride film).

Incidentally, in cases in which an ink jet recording apparatus is used, there are cases where the ink attaches to the nozzle forming surface in which nozzles are provided. The ink attached to the nozzle forming surface may thicken and harden by the water content or other volatile components included therein evaporating. There are cases of fiber waste or paper powder arising from the recording medium, such as paper or fabric, attaching to the nozzle forming surface. In this way, when foreign material such as ink, paper, fibers, or dust attaches to the nozzles or the vicinity of the nozzles, there are cases where the normal discharge of ink is impeded.

With respect to the problem of such discharge defects, JP-A-2001-260368 discloses using a fabric tape as a cleaning unit of the nozzle surface. JP-A-2009-101630 discloses subjecting the recording head supplied with a treatment liquid to wet wiping by a wiping member, such as rubber. JP-A-2010-274533 discloses absorbing the ink attached to the nozzle surface with a roll-like cleaning cloth, and discloses wetting the cleaning cloth with a cleaning solution. JP-A-2013-132753 discloses cleaning the ink discharge surface by wiping the discharge surface of the ink head using a cleaning member to which a liquid is supplied.

However, in the cleaning method of the nozzle forming surface disclosed in JP-A-2001-260368, because a liquid for cleaning the nozzle forming surface is not used, the nozzle forming surface may be damaged or the cleaning may be insufficient. In the cleaning method of the nozzle forming surface disclosed in JP-A-2009-101630, because a rubber wiper is used in cleaning, the cleaning of the nozzle surface may be insufficient, or the nozzle forming surface may be damaged.

On the other hand, non-aqueous inks are able to excellent record images as described above, while having a problem of being difficult to remove when attached to the nozzle forming surface. Therefore, even if cleaning of the nozzle forming surface is performed using the cleaning solutions (liquids) disclosed in JP-A-2010-274533 and JP-A-2013-132753, it was difficult to sufficiently remove the non-aqueous ink attached to the nozzle forming surface. In particular, according to the compatibility between the cleaning solution (liquid) and the non-aqueous ink, satisfactory cleaning properties are obtained and aggregation of components included in the non-aqueous ink arises, and ink discharge defects may occur regardless of whether cleaning of the nozzle forming surface is performed.

SUMMARY

An advantage of some aspects of the invention is to provide a cleaning method of an ink jet recording apparatus in which aggregation of the non-aqueous is suppressed and with excellent cleaning properties, and an ink jet recording apparatus in which the method is implemented.

The invention can be realized in the following forms or application examples.

Application Example 1

According to this application example, there is provided a maintenance method of an ink jet recording apparatus that performs recording of images on a recording medium using a non-aqueous ink, in which the ink jet recording apparatus includes a nozzle forming surface in which nozzles that discharge the non-aqueous ink are provided; and a wiping member with liquid absorbency, the method including wiping the nozzle forming surface with the wiping member using an impregnating solution, and in which the impregnating solution contains at least one organic solvent selected from a group consisting of compounds represented by the following General Formula (I), esters, and dibasic acid esters.

$$R^1—O—(R^2—O)_n—R^3 \quad (I)$$

(in General Formula (I) shown above, $R^1$ represents a hydrogen atom, an aryl group, or an alkyl group having 1 to 6 carbon atoms, $R^2$ represents an alkylene group having 2 to 4 carbon atoms, $R^3$ represents an aryl group or an alkyl group having 1 to 6 carbon atoms, and n represents an integer of 1 to 9.)

Application Example 2

In the maintenance method according to Application Example 1, it is preferable that the organic solvent included in the impregnating solution has a standard boiling point of 170° C. or higher.

Application Example 3

In the maintenance method according to Application Examples 1 or 2, it is preferable that the non-aqueous ink includes a glycol ether as the organic solvent and the content of the glycol ether is 20 mass % or more with respect to the total mass of the non-aqueous ink.

Application Example 4

In the maintenance method according to any one of Application Examples 1 to 3, it is preferable that the wiping is performed by the impregnating solution being held in the wiping member, and 20 parts by mass or more of the organic solvent is included in the impregnating solution held in the wiping member, with respect to 100 parts by mass of the wiping member.

Application Example 5

In the maintenance method according to any one of Application Examples 1 to 4, it is preferable that the wiping member is a fabric.

Application Example 6

In the maintenance method according to any one of Application Examples 1 to 5, it is preferable that the non-aqueous ink contains a lactone as the organic solvent.

Application Example 7

In the maintenance method according to any one of Application Examples 1 to 6, it is preferable that the wiping member holds the impregnating solution during shipping.

Application Example 8

In the maintenance method according to any one of Application Examples 1 to 7, it is preferable that the non-aqueous ink contains a fixing resin.

Application Example 9

In the maintenance method according to any one of Application Examples 1 to 8, it is preferable that the recording medium is heated to 35° C. or higher and used in an ink jet recording apparatus that performs recording of images.

Application Example 10

According to this application example, there is provided an ink jet recording apparatus that performs maintenance with the maintenance method according to any one of Application Examples 1 to 9.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, various embodiments of the invention will be described. The embodiments described below describe an example of the invention. The invention is not limited in any way by the following embodiments, and includes various modifications carried out in a range not departing from the gist of the invention. Not all of the configurations explained below are indispensable configurations in the invention.

1. MAINTENANCE METHOD

The maintenance method of an ink jet recording apparatus according to an aspect of the invention is a maintenance method of an ink jet recording apparatus that performs recording of images on a recording medium using a non-aqueous ink, in which the ink jet recording apparatus includes a nozzle forming surface in which nozzles that discharge the non-aqueous ink are provided; and a wiping member with liquid absorbency, the method including wiping the nozzle forming surface with the wiping member using an impregnating solution, and in which the impregnating solution contains at least one organic solvent selected from a group consisting of compounds represented by the following General Formula (I), esters, and dibasic acid esters.

$$R^1—O—(R^2—O)_n—R^3 \quad (I)$$

In General Formula (I) shown above, $R^1$ represents a hydrogen atom, an aryl group, or an alkyl group having 1 to 6 carbon atoms, $R^2$ represents an alkylene group having 2 to 4 carbon atoms, $R^3$ represents an aryl group or an alkyl group having 1 to 6 carbon atoms, and n represents an integer of 1 to 9.

Below, the maintenance method of the ink jet recording apparatus according to the embodiment will be described in the order of the configuration of the apparatuses able to execute the method, impregnating solution, and the non-aqueous ink, and, thereafter, the steps thereof will be described in detail.

1.1. Apparatus Configuration

The ink jet recording apparatus in which the maintenance method according to the embodiment is implemented includes a nozzle forming surface in which nozzles that discharge the non-aqueous ink are provided and a wiping member with liquid absorbency. Examples of such an ink jet recording apparatus include the ink jet printer shown in FIG. 1. The ink jet printer 1 shown in FIG. 1 includes a head maintenance device 26 incorporated in a known ink jet printer.

1.1.1. Nozzle Forming Surface

Figure 2:
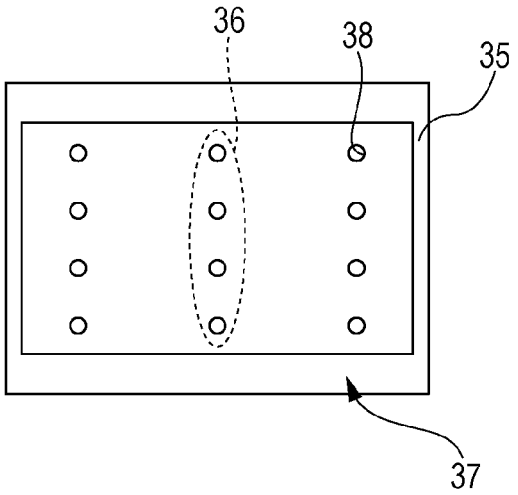
FIG. 2 is a schematic drawing schematically showing a nozzle forming surface of the ink jet recording apparatus according to an embodiment of the invention.

The nozzle forming surface is able to be arranged at a position facing the recording medium P of the recording head 22. FIG. 2 is a schematic drawing schematically showing the nozzle forming surface. As shown in FIG. 2, a plurality of nozzles (nozzle openings) 38 that discharge a non-aqueous ink (described later) are provided in the nozzle forming surface 37. Nozzle rows 36 are formed by a plurality of nozzles 38 being arranged in a predetermined pattern. As shown in FIG. 2, a plurality of nozzle rows 36 may be provided in the nozzle forming surface 37.

A liquid repellent film may be provided on the nozzle forming surface. The liquid repellent film is not particularly limited to a film having liquid repellency, and, for example, it is possible to form a molecular film of metallic alkoxide having liquid repellency, and thereafter, perform a drying process and an annealing process. Although the metallic alkoxide molecular film may be any material having liquid repellency, it is desirable that a metallic alkoxide monomolecular film has a long chain polymer group (long chain RF group) including fluorine, and a monomolecular film of a metallic acid salt having a water repellent group (for example, a long chain polymer group including fluorine). Although the metallic alkoxide is not particularly limited, silicon, titanium, aluminum, and zirconium are generally used as the metals thereof. Examples of the long chain RF group include a perfluoroalkyl group, and a perfluoropolyether group. Examples of the alkoxysilane having the long chain RF group include a silane coupling agent having a long chain RF group. Although the liquid repellent film is not particularly limited, it is possible to use a silane coupling agent (SCA) film or those disclosed in Japanese Patent No. 4424954. In particular, those having water repellency are referred to as water repellent films.

Although a conductive film may be formed on a substrate (nozzle plate) in which nozzles are formed and the liquid repellent film formed on the conductive film, a base film (plasma polymerization silicone (PPSi) film) is formed by first plasma polymerizing a silicon material, and the liquid repellent film may be formed on the base film. It is possible for the silicon material of the nozzle plate and the liquid repellent film to be thoroughly mixed by interposing the base film.

It is preferable that the liquid repellent film has a thickness of 1 nm to 30 nm, more preferably having a thickness of 1 nm and 20 nm is, and still more preferably having a thickness of 1 nm and 15 nm. By being in the above ranges, the liquid repellency of the nozzle forming surface tends to be superior, deterioration of the film is comparatively slow, and it is possible to maintain the liquid repellency over a longer time period. The film is superior also in terms of cost and ease of film formation.

A nozzle plate cover that at least partially covers the nozzle forming surface may be provided on the nozzle forming surface. In the example in FIG. 2, the nozzle plate cover 35 is provided so as to surround all of the nozzle rows 36 (nozzles 38). The nozzle plate cover serves either a role of fixing the nozzle tips or a role of preventing the recording medium direct contacting the nozzles by the recording medium floating upward, in a nozzle forming surface of a head formed by a combination of a plurality of nozzle tips (below, simply referred to as "tip"). By covering at least a portion of the nozzle forming surface, the nozzle plate cover is provided in a state of protruding from the nozzles when viewed from the side surface. In cases where the nozzle plate cover is provided, the non-aqueous ink easily remains in a corner (gap) between the nozzle forming surface and the nozzle plate cover projected therefrom, and a problem may arise of the adhesion between the cap and the nozzle surface being insufficient, and the capping operation becoming defective. The problem becomes particularly remarkable according to the type of resin included in the non-aqueous ink. It is possible for the non-aqueous ink deposited in the gap to be removed by the wiping member abutting between the nozzle plate cover and the nozzle, and the capping operation is favorable stabilized.

Using the impregnating solution when performing the wiping step, described later, on the nozzle forming surface, wiping is performed while attaching the impregnating solution to the nozzle forming member. More specifically, when performing the wiping step, by the impregnating solution being attached to either or both of the nozzle forming surface and the wiping member using a known spraying apparatus or coating apparatus, and then wiping the nozzle forming surface with the wiping member, and by performing wiping of the nozzle forming surface with the wiping member holding the impregnating solution in a state where the wiping member is impregnated with the impregnating solution or the wiping member is impregnated in advance with the impregnating solution, the impregnating solution may be attached to the nozzle forming surface.

1.1.2. Wiping Member

The wiping member wipes the nozzle forming surface is used in subjecting the nozzle and the nozzle forming surface to cleaning by absorbing or adsorbing attached materials (for example, non-aqueous ink, impregnating solution, fibers, paper, dust and the like) attached to the nozzles and the nozzle forming surface. In so doing, since the pigment particles included in the non-aqueous ink is absorbed into the interior of the wiping member, pigment particles do not remain on the surface of the wiping member. Therefore, it is possible to suppress the water repellent film (nozzle forming surface) being damaged by the pigment particles.

The wiping member is not particularly limited as long as it has liquid absorbency, and examples thereof include a fabric (textile, knitted product, non-woven material, and the like), a sponge, and pulp. Among these, a fabric is preferable. The cleaning member easily bends if a fabric is used, and in a case where a nozzle plate cover is provided, ink attached to the nozzle forming surface is more easily wiped off. Although not particularly limited, examples of the fabric include those made from cupra, polyester, polyethylene, polypropylene, lyocell, and rayon. In this case, it is preferable to select a material that does not easily deteriorate due to the impregnating solution.

It is possible for the thickness of the wiping member to be appropriately set as desired, and to be made 0.1 mm to 3 mm. By the thickness being 0.1 mm or more, the impregnating solution is more easily held. By the thickness being 3 mm or less, the wiping member is more compact, size reductions are possible in the maintenance unit overall, and mechanical transport of the wiping member becomes easier.

It is preferable that the surface density of the wiping member is 0.005 g/cm$^2$ to 0.15 g/cm$^2$. 0.02 g/cm$^2$ or 0.13 g/cm$^2$ is more preferable. By being in the above ranges, the impregnating solution is more easily held. It is preferable for the wiping member to use a fabric for which the surface density and the thickness are easily designed in order to hold the impregnating solution.

It is preferable for the wiping member to hold the impregnating solution during shipping. In so doing, it is possible to immediately perform wiping of the nozzle forming surface, and it becomes unnecessary to provide a mechanism that coats the nozzle forming surface by discharging the impregnating solution. Here, "holding the impregnating solution during shipping" refers to a state in which the wiping member already holds the impregnating solution when installing the ink jet recording apparatus provided with the wiping member, a state where the wiping member already holds the impregnating solution when installing the wiping member in the ink jet recording apparatus, or a state in which a replaceable wiping member holds the impregnating solution. Here, "install the ink jet recording apparatus" refers to preparing the ink jet recording apparatus for first use, and "install the wiping member" refers to preparing the wiping member for first use. In the embodiment, wiping of the nozzle forming surface performed using the wiping member may be wiping of at least the nozzle forming surface by the wiping member. Wiping at least a portion of the attached materials attached to the nozzle forming surface with the wiping member is preferable.

1.1.3. Driving Mechanism

The ink jet recording apparatus according to the embodiment may include a driving mechanism. The driving mechanism is a unit that executes the wiping step by relatively moving at least one of the wiping member and the recording head with respect to the other and removing the attached materials attached to the nozzle forming surface with the wiping member. It is preferable that the driving mechanism includes a pressing member that relatively presses the wiping member and the nozzle forming surface at a 50 gf to 500 gf (75 gf to 300 gf is preferable). The cleaning properties are favorable by the pressing force being 50 gf or more. Even in a case of a difference between the nozzle plate and the nozzle plate cover, attachment and accumulation of ink in the gap is prevented, or removal of the ink from the gap is excellent. By the pressing force being 500 gf/cm or less, the storage properties of the liquid repellent film are significantly superior. Although not particularly limited, it is possible to use a driving mechanism that presses the wiping member from the side opposite to the side that contacts the nozzle forming member, and brings the wiping member and the nozzle forming surface into contact with each other. It is possible for the recording head to be driven and for the wiping member and the nozzle forming surface to be brought into contact. The load referred to here is sum total of the load applied to the nozzle forming surface from the entire driving mechanism.

It is preferable that the driving mechanism relatively moves the wiping member and the recording head at a speed of 1 cm/s to 10 cm/s. By being in this range, the cleaning properties and the storage properties of the liquid repellent film are further improved. Although the speed of the cleaning operation is a slow speed of approximately one-fifth to one-twentieth compared to the speed the recording head ordinarily moves when recording an image, there is no limitation on the speed relationship.

Although not particularly limited, it is preferable that the pressing member is covered by an elastic member. It is preferable that the Shore A hardness of the elastic member is 10 to 60, and 10 to 50 is more preferable. In so doing, it is possible for the pressing member and the wiping member to bend when pressed, and the wiping member is pushed inward with respect to the concave-convex surface formed from the nozzle forming surface. In particular, in a case where there is a nozzle plate cover, it is possible to press the wiping member inward with respect to the angle (gap) between the nozzle forming surface and the nozzle plate projecting therefrom, and possible to suppress the accumulation of ink. As a result, the cleaning properties are further improved.

1.2. Impregnating Solution

An impregnating solution is used in the maintenance method of the ink jet recording apparatus according to the embodiment. The impregnating solution is supplied to the nozzle forming surface when performing at least the wiping step, described later. Specifically, the impregnating solution may be supplied and attached to the nozzle forming surface using a known spraying apparatus or the like when performing the wiping step, or may be attached to the nozzle forming surface by being held in the wiping member when performing the wiping step.

Below, the components included in the impregnating solution and the components able to be included will be described.

Organic Solvent

The impregnating solution contains at least one type of organic solvent (below, referred to as "specified organic solvent") selected from a group consisting of a compound represented by the following General Formula (I), esters, and dibasic acid esters. The specified organic solvent may be used singly, or two or more types may be used together.

Since the specified organic solvent has an excellent action in which the non-aqueous ink attached to the nozzle forming surface is dissolved (softened), in addition to being able to suppress the components included in the non-aqueous ink from aggregating, and it is possible for the cleaning properties of the nozzle forming surface to also be improved.

$$R^1—O—(R^2—O)_n—R^3 \quad (I)$$

In General Formula (I) shown above, $R^1$ represents a hydrogen atom, an aryl group, or an alkyl group having 1 to 6 carbon atoms, $R^2$ represents an alkylene group having 2 to 4 carbon atoms, $R^3$ represents an aryl group or an alkyl group having 1 to 6 carbon atoms, and n represents an integer of 1 to 9. Examples of the "aryl group" include phenyl groups, benzyl groups, tolyl groups, xylyl groups, naphthyl groups, methyl naphthyl groups, benzyl phenyl groups, and biphenyl groups. It is possible for the "alkyl group having 1 to 6 carbon atoms" to be a linear or a branched alkyl group, and examples thereof include a methyl group, an ethyl group, an n-propyl group, an iso-propyl group, an n-butyl group, a sec-butyl group, an iso-butyl group, a tert-butyl group, and a pentyl group. Examples of the "alkylene group having 2 to 4 carbon atoms" include ethylene groups and n-propylene groups iso-propylene groups, or butylene groups.

In the General Formula (I) shown above, it is preferable for $R^1$ to be a hydrogen atom or an alkyl group having 2 to 4 carbon atoms. In General Formula (I) shown above, it is preferable for $R^3$ to be an alkyl group having 2 to 4 carbon atoms. In so doing, the action in which the non-aqueous ink is dissolved (softened) is improved, and the cleaning properties become more favorable.

In General Formula (I) shown above, it is preferable for n to be an integer of 3 to 6. In so doing, the action in which the non-aqueous ink is dissolved (softened) is improved, and the cleaning properties become more favorable.

Specific examples of the compound represented by General Formula (I) shown above include glycol ethers, such as alkylene glycol monoether, and alkylene glycol diether. It is possible for the glycol ethers to be used individually, or for a mixture of two or more types to be used.

Examples of the alkylene glycol monoether include ethylene glycol monomethyl ether, ethylene glycol monoethyl ether, ethylene glycol monoisopropyl ether, ethylene glycol monobutyl ether, ethylene glycol mono-hexyl ether, ethylene glycol mono phenyl ether, diethylene glycol monomethyl ether, diethylene glycol monoethyl ether, diethylene glycol monobutyl ether, diethylene glycol mono-hexyl ether, diethylene glycol mono benzyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, pentaethylene glycol monomethyl ether, pentaethylene glycol monoethyl ether, pentaethylene glycol monobutyl ether, propylene glycol monomethyl ether, propylene glycol monoethyl ether, dipropylene glycol monomethyl ether, and dipropylene glycol monoethyl ether.

Examples of the alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

Examples of the esters (R—CO—OR') include organic solvents for which R is a hydrogen atom, an alkyl group, an aryl group or a glycol ether group, and R' is an alkyl group or an aryl group. It is preferable to use a glycol ether ester as such an ester, and examples thereof include ethylene glycol monomethyl ether acetate, ethylene glycol monoethyl ether acetate, ethylene glycol mono-propyl ether acetate, ethylene glycol monobutyl ether acetate, propylene glycol monomethyl ether acetate, propylene glycol monoethyl ether acetate, propylene glycol mono-propyl ether acetate, propylene glycol monobutyl ether acetate, dimethylene glycol monomethyl ether acetate, dimethylene glycol monoethyl ether acetate, dimethylene glycol monopropyl ether acetate, dimethylene glycol monobutyl ether acetate, diethylene glycol monomethyl ether acetate, diethylene glycol monoethyl ether acetate, diethylene glycol mono-propyl ether acetate, diethylene glycol monobutyl ether acetate, dipropylene glycol monobutyl ether acetate, dipropylene glycol monoethyl ether acetate, dipropylene glycol monopropyl ether acetate, dipropylene glycol monomethyl ether acetate, trimethylene glycol monomethyl ether acetate, trimethylene glycol monoethyl ether acetate, trimethylene glycol monopropyl ether acetate, trimethylene glycol monobutyl ether acetate, triethylene glycol monomethyl ether acetate, triethylene glycol monoethyl ether acetate, triethylene glycol monopropyl ether acetate, triethylene glycol monobutyl ether acetate, tripropylene glycol monomethyl ether acetate, tripropylene glycol monoethyl ether acetate, tripropylene glycol monopropyl ether acetate, tripropylene glycol monobutyl ether acetate, 3-methoxy butyl acetate, and 3-methoxy-3-methyl-1-butyl acetate.

Examples of the dibasic acid ester include monoesters and diesters of dicarboxylic acid (for example, aliphatic dicarboxylic acids such as glutaric acid, adipic acid, and succinic acid). Specific examples include dimethyl-2-methylglutarate.

Among the specified organic solvents, using a compound represented by General Formula (I) shown above is preferable, from the feature of having excellent action of dissolving (softening) the non-aqueous ink.

Using a solvent with a standard boiling point 170° C. or higher as the specified organic solvent is preferable. And using one with a standard boiling point of 250° C. or higher is more preferable. In so doing, since it is possible to lower the occurrence of nozzle clogging accompanying the drying of the impregnating solution, the discharge stability of the non-aqueous ink becomes favorable.

It is preferable to use a solvent with a vapor pressure at 20° C. of 1 hPa or less as the specified organic solvent, using one with a vapor pressure of 0.5 hPa or less is more preferable, 0.1 hPa or less is still more preferable, and 0.01 hPa or less is particularly preferable. In so doing, since it is possible to lower the occurrence of nozzle clogging accompanying the drying of the impregnating solution, the discharge stability of the non-aqueous ink becomes favorable.

It is preferable to use a specified organic solvent with a surface tension at 20° C. of 25 mN/m to 35 mN/m. In so doing, since compatibility with the non-aqueous ink, described later, is improved, and the cleaning properties tend to be further improved. The measurement of the surface tension may be measured by verifying the surface tension when a platinum plate is wetted with an organic solvent in an environment of 20° C. by using a Full Automatic Surface Tensiometer CBVP-Z (manufactured by Kyowa Interface Science Co., Ltd.).

It is preferable that the content of the specified organic solvent have a lower limit value of 30 mass % or more with respect to the total mass (100 mass %) of the impregnating solution, and 50 mass % or more is more preferable. By the content of the specified organic solvent being 50 mass % or more, the cleaning properties of the nozzle forming surface are further improved. The upper limit of the content of the specified organic solvent with respect to the impregnating solution is not limited and may be 100 mass %.

In cases where the wiping step, described later, is performed using the wiping member in which the impregnating solution is held, it is preferable that 10 parts by mass or more of the specified organic solvent is included in the impregnating solution held in the wiping member with respect to 100 parts by mass of the wiping member, 15 parts by mass or more is more preferable, 20 parts by mass or more is still more preferable, 40 parts by mass or more is still more preferable, and 50 parts by mass or more is particularly preferable. It is preferable that the upper limit thereof is 150 parts by mass or less, and 100 parts by mass or less is more preferable. By being 10 parts by mass or more, since the ink hardened on the nozzle forming surface is easily dissolved (softened), the cleaning properties are further improved. By being 150 parts by mass or less, since the ink is easily absorbed in the wiping member, discharge anomalies or non-discharges of the nozzles due to ink being left do not easily arise, the ink discharge stability becomes favorable.

The impregnating solution according to the embodiment may contain organic solvents other than the specified organic solvent. Since examples of such an organic solvent are the organic solvents given in the non-aqueous ink, described later, description thereof will not be provided.

Other Components

It is possible for the impregnating solution according to the embodiment to further contain substances for imparting predetermined capabilities, such as surfactants, pH adjusters, chelating agents, preservatives or fungicides, and antirust agents.

1.3. Non-Aqueous Ink

The ink jet recording apparatus in which the maintenance method according to the embodiment is applied performs recording of images on a recording medium using the non-aqueous ink.

"Non-aqueous ink" in the invention is an ink with an organic solvent as a main solvent and not having water as a main solvent. It is preferable that the content of water in the ink is 3 mass % or less, 1 mass % or less is more preferable, less than 0.05 mass % is still more preferable, still more preferable is less than 0.01 mass %, still more preferable is less than 0.005 mass %, and less than 0.001 mass % is most preferable. Alternatively, the ink may be one not substantially containing water. "Not substantially containing" indicates not being intentionally contained. In cases where the non-aqueous ink composition includes other components than the solvent, such as a coloring material or resin, it is possible to make the content of the organic solvent in the non-aqueous ink the remaining amount of the remainder except for the other components, for example, 70 mass % or more, and 80 mass % or more is further possible, and possible for the upper limit of the content to be 100 mass % or less, and 99 mass % or less is more possible.

Even though the non-aqueous ink has the advantages of excellent waterproofness and excellent drying properties when attached to a low absorbency recording medium in light of having the organic solvent as the main solvent, a problem arises of easily attaching to the nozzle forming surface and being difficult to remove. In contrast to such a problem, if the nozzle forming surface to which the non-aqueous ink is attached is wiped using the above-described impregnating solution, it is easy to maintain the cleanliness of the nozzle forming surface with the action of the impregnating solution.

Below, the components included in the non-aqueous ink and the components able to be included will be described.

Organic Solvent

It is preferable that the non-aqueous ink contains a glycol ether as the organic solvent. It is possible for the glycol ethers to control the wettability or the permeation rate with respect to the recording medium and to suppress unevenness in the recorded image.

Examples of the glycol ethers include alkylene glycol monoether and alkylene glycol diether. It is possible for the glycol ethers to be used individually, or for a mixture of two or more types to be used.

Examples of the alkylene glycol monoether include ethylene glycol monomethyl ether, ethylene glycol monoethyl ether, ethylene glycol monoisopropyl ether, ethylene glycol monobutyl ether, ethylene glycol monohexyl ether, ethylene glycol monophenyl ether, diethylene glycol monomethyl ether, diethylene glycol monoethyl ether, diethylene glycol monobutyl ether, diethylene glycol monohexyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, dipropylene glycol monomethyl ether, and dipropylene glycol monoethyl ether.

Examples of the alkylene glycol diether include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, diethylene glycol butyl methyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, and dipropylene glycol diethyl ether.

It is preferable that the lower limit of the content of the glycol ether included in the non-aqueous ink is 10 mass % or more with respect to the total mass (100 mass %) of the non-aqueous ink, 20 mass % or more is more preferable, and 30 mass % or more is still more preferable. It is preferable that the upper limit is 95 mass % or less, 90 mass % or less is more preferable, 85 mass % or less is still more preferable, 80 mass % or less is still more preferable, and 75 mass % or less is particularly preferable. By the content being 20 mass % or more, the wetting and spreading properties of the liquid droplets are improved, and it is possible to form a favorable image with excellent smoothness. By the content of the glycol ether-based solvent being 95 mass % or less, there are cases of being able to suppress aggregation unevenness due to excessive wetting and spreading.

It is preferable that the non-aqueous ink according to the embodiment includes a lactone as the organic solvent. It is possible for the lactone to causing the non-aqueous ink to penetrate to the interior of the recording medium by dissolving a portion of the recording surface (a recording surface including a vinyl chloride resin is preferable), thereby increasing the adhesiveness of the non-aqueous ink with respect to the recording medium. "Lactone" in the invention generally refers to cyclic compound having an ester group (—CO—O—) in the ring. Although not particularly limited as long as it is included in the above definition, it is preferable that the lactone is a lactone having 2 to 9 carbon atoms. Although specific examples of such a lactone include α-ethyl lactone, α-acetolactone, β-propiolactone, γ-butyrolactone, δ-valerolactone, ϵ-caprolactone, ξ-enantiolactone, η-caprylo lactone, γ-valerolactone, γ-heptalactone, γ-nonalactone, β-methyl-δ-valerolactone, 2-butyl-2-ethyl-propiolactone, and α,α-diethylpropiolactone, and among these γ-butylolactone is particularly preferable. The lactones given as examples above may be used singly, or 2 or more types may be mixed and used.

In a case where lactone is contained, it is preferable that the content thereof is 5 mass % or more with respect to the total mass of the non-aqueous ink, and 10 mass % or more is more preferable. By the content of the lactone being 5 mass % or more, the abrasion resistance of the image tends to be further improved. It is preferable that the content thereof is 75 mass % or less, 40 mass % or less is more preferable, and 30 mass % or less is still more preferable. By being 75 mass % or less, the glossiness of the image tends to be improved.

Other Organic Solvent

The non-aqueous ink may include esters, hydrocarbons, or alcohols as another organic solvent other than the above in addition to or instead of the above-described organic solvents. Examples of the esters include methyl acetate, ethyl acetate, n-propyl acetate, isopropyl acetate, n-butyl acetate, isobutyl acetate, isopentyl acetate, secondary butyl acetate, amyl acetate, methoxy-butyl acetate, methyl lactate, ethyl lactate, butyl lactate, methyl caprylate, ethylene glycol monomethyl ether acetate, ethylene glycol monoethyl ether acetate, propylene glycol monomethyl ether acetate, propylene glycol monoethyl ether acetate, diethylene glycol monomethyl ether acetate, diethylene glycol monoethyl ether acetate, and diethylene glycol monobutyl ether acetate.

Examples of the hydrocarbon include aliphatic hydrocarbons (for example, paraffin, isoparaffin), alicyclic hydrocarbons (for example, cyclohexane, cyclooctane, cyclodecane and the like), and aromatic hydrocarbons (for example, benzene, toluene, xylene, naphthalene, tetralin and the like). Commercially available hydrocarbons may be used and examples thereof include aliphatic hydrocarbon solvents or alicyclic hydrocarbon solvents such as IP Solvent 1016, IP Solvent 1620, and IP Clean LX (all trade names, manufactured by Idemitsu Kosan Co., Ltd), Isopar G, Isopar L, Isopar H, Isopar M, Exxosol D40, Exxosol D80, Exxosol D100, Exxosol D130, and Exxosol D140 (all trade names manufactured by Exxon Mobil Corporation), NS Clean 100, NS Clean 110, NS Clean 200, and NS Clean 220 (all trade names manufactured by JX Nippon Oil & Energy Corporation), Naphtesol 160, Naphtesol 200, and Naphtesol 220 (all trade names manufactured by JX Nippon Oil & Energy Corporation), and aromatic hydrocarbon solvents such as Solvesso 200 (trade name manufactured by Exxon Mobil Corporation).

Examples of the alcohols include methanol, ethanol, isopropanol, 1-propanol, 1-butanol, 2-butanol, 3-pentanol, 2-methyl-1-butanol, 2-methyl-2-butanol, iso-amyl alcohol, 3-methyl-2-butanol, 3-methoxy-3-methyl-1-butanol, 4-methyl-2-pentanol, allyl alcohol, 1-hexanol, 1-heptanol, 2-heptanol, and 3-heptanol. These other solvents may be used singly or two or more may be used, and it is preferable that the content of one or more thereof be 10 mass % or more with respect to the total mass of the non-aqueous ink, 30 mass % or more is more preferable, and 50 mass % or more is still more preferable, and 90 mass % or less is preferable and 80 mass % or less is more preferable.

Resin

It is preferable that the non-aqueous ink used in the embodiment contains a resin. Examples of the resin include a resin that protects the image obtained with the non-aqueous ink by forming a coating film, a resin for improving adhesiveness of the ink coating film of the image, a resin for adjusting the glossiness of the ink coating film of the image, in addition to a resin for improving the quality of the ink coating film of the image. A resin having at least a function of forming a coating film and protecting the image obtained with the non-aqueous ink is preferable because of the color fastness to rubbing of the recording material, and the embodiment of the invention is particularly useful. The resin is referred to as a fixing resin.

Examples of the resin include (meth)acrylic resins (for example, poly(meth)acrylic acid, poly(meth)acrylic acid methyl, poly(meth)acrylic acid ethyl, (meth)acrylic acid-(meth)acrylic acid ester copolymer resin, styrene-(meth) acrylic copolymer resin, ethylene-(meth)acrylic acid copolymer resin, ethylene-alkyl (meth)acrylate resins, ethylene-(meth)acrylic acid ester copolymer resin and the like), vinyl chloride-based resins, (for example, polyvinyl chloride, vinyl chloride-vinyl acetate copolymer resins, and the like), aliphatic polyesters, aromatic polyesters, polyurethanes, epoxy resins, polyvinyl acetates, ethylene-vinyl acetate copolymer resins, polycarbonates, polyvinyl butyrals, polyvinyl alcohol, phenoxy resins, ethyl cellulose resins, cellulose acetate propionate resins, cellulose acetate butyrates, nitrocellulose resins, polystyrenes, vinyl toluene-α-methyl styrene copolymer resins, polyamides, polyimides, polysulfone resins, petroleum resins, chlorinated polypropylenes, polyolefins, terpene resins, rosin-modified phenolic resins, various synthetic rubbers such as NBR, SBR, and MBR, and modifications thereof. These resins may be used singly, or 2 or more types may be mixed and used.

Among the above resins, from the viewpoint of further improving the abrasion resistance of the image, using at least one of a (meth)acrylic resin and a vinyl chloride resin is preferable. The (meth)acrylic resin includes at least either of (meth)acrylate or (meth)acrylic acid as the monomer component used during synthesis of the resin, and the vinyl chloride resin includes at least vinyl chloride as the monomer component used during synthesis of the resin.

Commercially available (meth)acrylic resins may be used, and examples thereof include ACRYPET MF (trade name, manufactured by Mitsubishi Rayon Co., Ltd.), SUMIPEX LG (trade name, manufactured by Sumitomo Chemical Co., Ltd., acrylic resin), Paraloid B-series (trade name, Rohm and Haas Co., Ltd., acrylic resin), and PARAPET G-1000P (trade name, Kuraray Co., Ltd., acrylic resin). In the embodiment, "(meth)acrylic acid" refers to both acrylic acid and methacrylic acid, and "(meth)acrylate" refers to both acrylate and methacrylate.

Commercially available vinyl chloride resins may be used, and examples thereof include Kanevinyl S-400 and HM515 (trade names, manufactured by Kaneka Corporation), and SOLBIN C (trade name, manufactured by Nissin Chemical Industry Co., Ltd.).

Although any type of resin, such as in a solid form, solution form, and an emulsion state, may be used as the resin included in the non-aqueous ink, it is preferable to use one that dissolves in ink (resin dissolved in ink).

It is preferable that the content of the resin in solid conversion is from 0.5 mass % to 10 mass % with respect to the total mass of the non-aqueous ink, from 0.5 mass % to 6 mass % is more preferable, and from 0.5 mass % to 5 mass % is still more preferable. By the content of the resin being 0.5 mass % or more, the abrasion resistance of the image tends to be further improved. By making the content of the resin 10 mass % or less, it is possible to easily set the viscosity of the non-aqueous ink to a range suitable to ink jet recording.

Coloring Material

The non-aqueous ink according to the embodiment may contain a coloring material. Although a dye may be used as the coloring material and it is possible to use a pigment such as an inorganic pigment and an organic pigment, it is preferable to use a pigment from the viewpoint of light resistance and the like. These coloring materials may be used singly or 2 or more types may be mixed and used.

Examples of the organic pigment include azo pigments (such as azo lake, insoluble azo pigments, condensed azo pigments, and chelate azo pigments); polycyclic pigments (such as phthalocyanine pigments, perylene and perylene pigments, anthraquinone pigment, quinacridone pigment, dioxazine pigments, thioindigo pigments, isoindolinone pigments, and quinophthalone pigments); dye lakes (such as basic dye type lakes, and acid dye type lakes); nitro pigments, nitroso pigments, aniline black, and daylight fluorescent pigments. Examples of the inorganic pigment include carbon black, titanium dioxide, silica, and alumina.

It is possible for the content of the coloring material to be appropriately set as desired, and although not particularly limited, the content is ordinarily 0.1 mass % to 10 mass % with respect to the total mass of the non-aqueous ink.

In a case of using a pigment as the coloring material, a pigment dispersant may be contained, and examples thereof include polyester polymer compounds such as Hinoact KF1-M, T-6000, T-7000, T-8000, T-8350P, and T-8000E (all manufactured by Takefu Fine Chemical Co., Ltd.), Solsperse 20000, 24000, 32000, 32500, 33500, 34000, 35200, and 37500 (all manufactured by LUBRIZOL Co., Ltd.), Disperbyk-161, 162, 163, 164, 166, 180, 190, 191, 192, 2091, 2095 (all manufactured by BYK-Chemie Japan Co., Ltd.), Flowlen DOPA-17, 22, 33, and G-700 (all manufactured by Kyoeisha Chemistry Co., Ltd.), Ajisper PB821, and PB711 (all manufactured by Ajinomoto Fine-Techno Co., Inc.), LP4010, LP4050, LP4055, POLYMER 400, 401, 402, 403, 450, 451, and 453 (all manufactured by EFKA Chemicals Co., Ltd.). Although it is possible to select, as appropriate, the content in a case of using a pigment dispersant according to the pigment included, 5 parts by mass to 200 parts by mass with respect to 100 parts by mass of the content of the pigment in the non-aqueous ink is preferable, and 30 parts by mass to 120 parts by mass is more preferable.

Other Components

It is possible for the non-aqueous ink according to the embodiment to contain materials for imparting predetermined capabilities such as surfactants (for example, silicon-based surfactants, acetylene glycol-based surfactant, fluorine-based surfactants, and the like), pH adjusters, chelating agents such as ethylenediamine tetraacetate (EDTA), preservatives or fungicides and antirust agents.

Method of Preparing Non-Aqueous Ink

The non-aqueous ink according to the embodiment is obtained by mixing the above-mentioned components in an arbitrary order, and removing impurities by performing filtration or the like as necessary. As the method of mixing each component, a method of sequentially adding materials to a container provided with a stirring apparatus such as a mechanical stirrer or a magnetic stirrer and then stirring and mixing is favorably used. As the method of filtration, it is possible to perform centrifugal filtration, filtration using a filter, or the like as necessary.

Properties of Non-Aqueous Ink

From the viewpoint of the balance between the recording quality and the reliability as an ink for an ink jet recording, it is preferable that the non-aqueous ink according to the embodiment has a surface tension at 20° C. of 20 mN/m to 50 mN/m, and 25 mN/m to 40 mN/m is more preferable. Furthermore, it is possible for the measurement of the surface tension to be measured by verifying the surface tension when a platinum plate is wetted with ink in an environment of 20° C. by using a Full Automatic Surface Tensiometer CBVP-Z (manufactured by Kyowa Interface Science Co., Ltd.).

From a similar viewpoint, it is preferable that the viscosity of the non-aqueous ink at 20° C. is from 2 mPa·s to 15 mPa·s, and from 2 mPa·s to 10 mPa·s is more preferable. It is possible for the measurement of the viscosity to be measured by raising the Shear Rate from 10 to 1000 and reading the viscosity when the Shear Rate is at 200 in an environment of 20° C. by using a Viscoelastic Testing Machine MCR-300 (manufactured by Pysica Co., Ltd).

1.4. Steps

The maintenance method of the ink jet recording apparatus according to the embodiment includes a wiping step of wiping the nozzle forming surface supplied with the above-described impregnating solution with the wiping member. In this way, in the wiping step, since the nozzle forming surface is wiped using the above-described impregnating solution, the cleaning properties of the nozzle forming surface are excellent.

Figure 3:
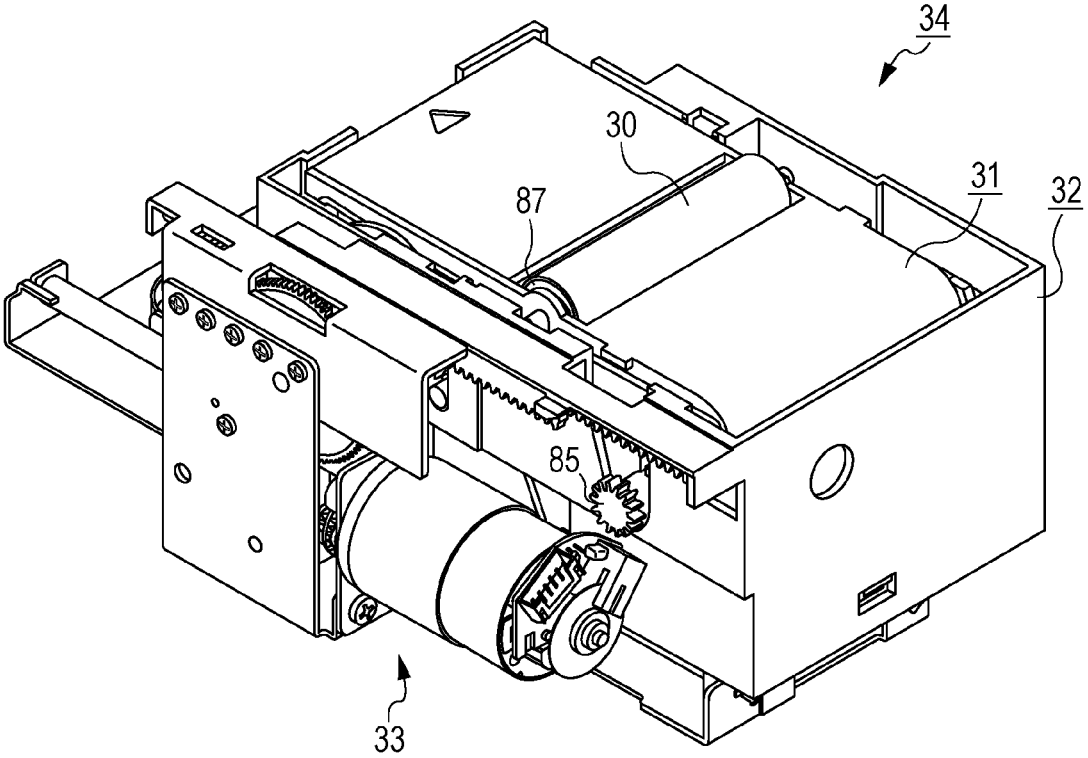
FIG. 3 is a perspective drawing schematically showing a wiper unit of the ink jet recording apparatus according to an embodiment of the invention.
Figure 4A:
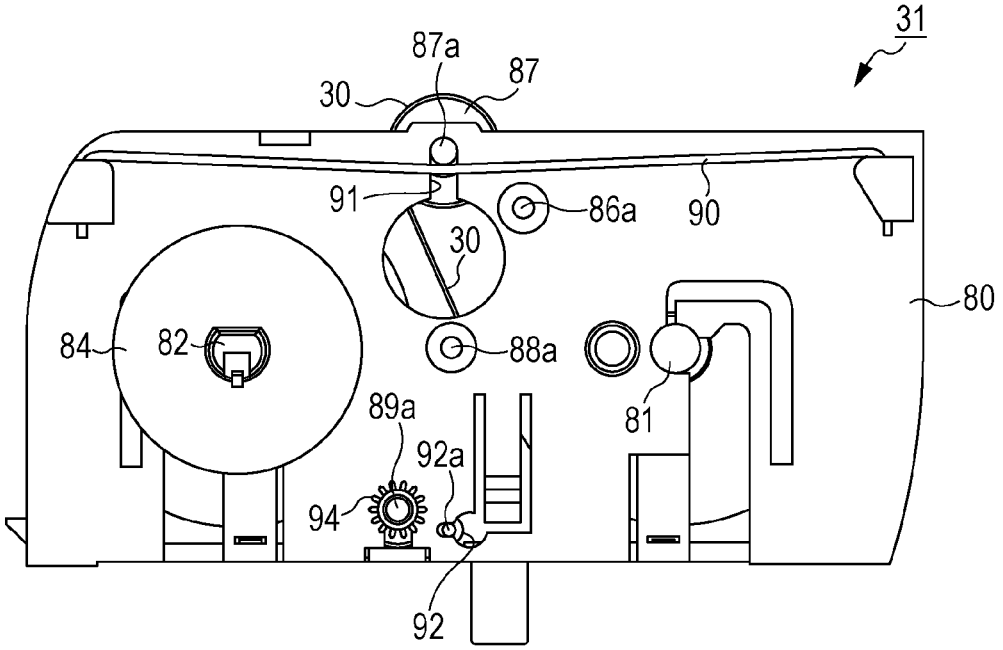
FIGS. 4A and 4B are front views schematically showing a wiper cassette of the ink jet recording apparatus according to an embodiment of the invention.

An example of the wiping step according to the embodiment will be described in detail with reference to the drawings. FIG. 3 is a perspective drawing schematically showing a wiper unit 34 that is an example of a head maintenance device 26. FIG. 4A is a front view of a wiper cassette 34, and FIG. 4B is a front view of a wiper cassette 34 not depicting the housing.

Figure 1:
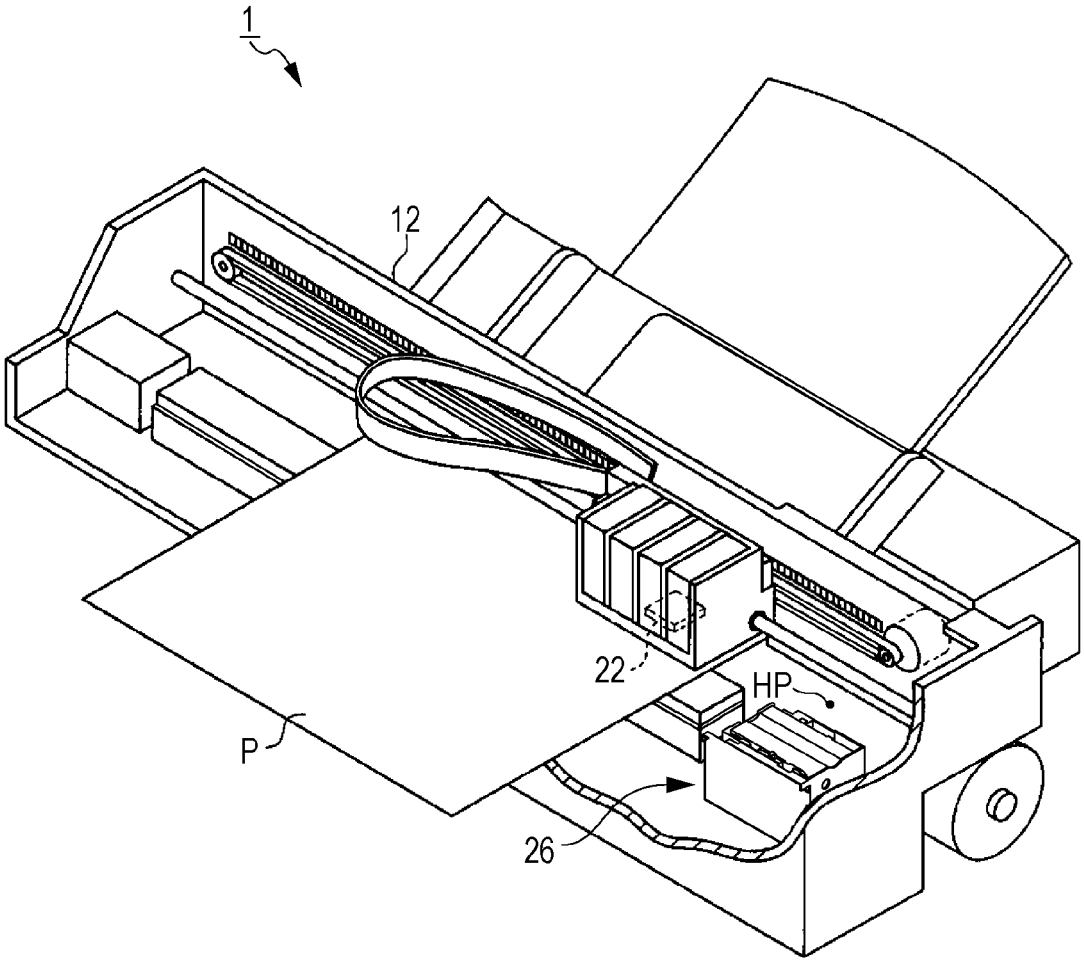
FIG. 1 is a drawing schematically showing an ink jet recording apparatus according to an embodiment of the invention.

As shown in FIG. 1, a head maintenance device 26 for performing maintenance of the recording head 22 is provided at the home position HP provided on the right side of the recording region to which the recording sheet P is transported in the frame 12.

The head maintenance device 26 includes a wiper cassette 31 to which the wiping member 30 that wipes the ink from the nozzle forming surface of the recording head 22 is mounted, a wiper holder 32 to which the wiper cassette 31 is mounted to be freely attached and detached, and a wiper unit 34 formed from a movement mechanism 33 by which the wiper holder 32 is moved in the nozzle row direction (transport direction of the recording medium in FIG. 1) of the recording head 22. The head maintenance device 26 may be provided with a cap (not shown) provided able to abut with respect to the nozzle forming surface of the recording head 22 so as to surround the nozzles, and a suction pump (not shown) that is driven to suction and discharge ink that is thickened or the like from the inside of the recording head 22 as waste ink via the cap, in addition to the wiper unit 34. The driving mechanism according to the embodiment is a mechanism for pressing the wiping member including the impregnating solution and the nozzle forming surface, is formed from at least the pressing member 87 and the rod spring 90 in FIG. 4A, and may also include a movement mechanism 33.

Figure 4B:
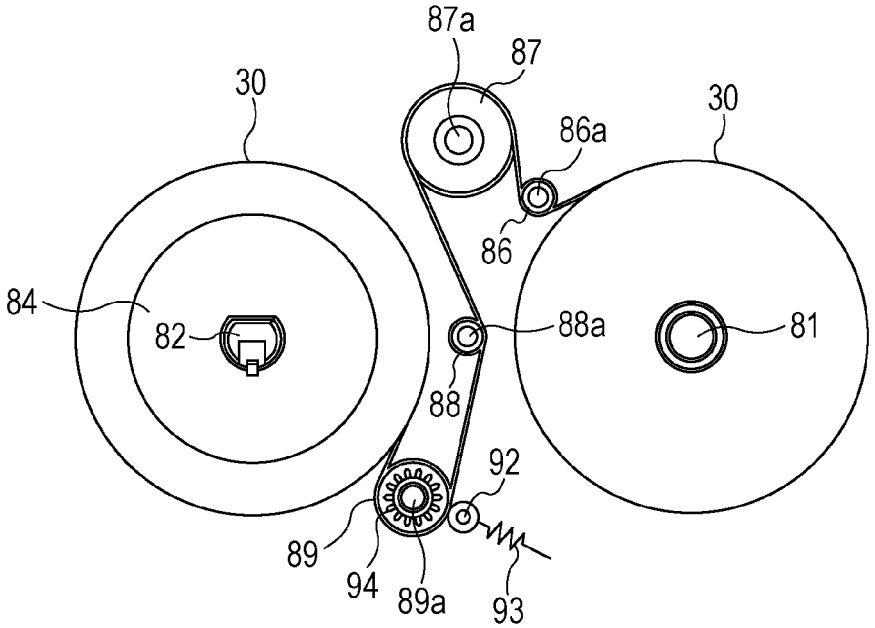

As shown in FIGS. 4A and 4B, on the inside of the housing 80 formed in a substantially rectangular box shape that configures the exterior case of the wiper cassette 31, a pair of rollers 81 and 82 having an axial line that extends horizontally in the front to rear direction that is the short axis direction of the housing 80 is accommodated at a distance in the left-to-right direction that is the long axis direction of the housing 80. The long wiping member 30 for wiping ink form the nozzle forming surface of the recording head 22 is latched between the pair of rollers 81 and 82. From the pair of rollers 81 and 82, the delivery roller 81 as a first roller provided on the leftward side near the recording region in which the recording head 22 executes recording with respect to the recording sheet (recording medium) P unreels the wound unused wiping member 30. Meanwhile, from the pair of rollers 81 and 82, the winding roller 82 as a second roller on the rightward side near opposite the recording region in which the recording head 22 executes recording with respect to the recording sheet P winds up the used wiping member 30 used in wiping by being unwound from the delivery roller 81. The delivery roller 81 and the winding roller 82 are positioned at substantially the same height as one another. A delivery gear is provided to be able to rotate integrally with the delivery roller 81 on one end portion (front end portion) in the axial direction of the delivery roller 81 exposed to the outside of the housing 80. Winding gears 84 and 85 are provided to be able to rotate integrally with the winding roller 82 on both end portions in the axial direction of the winding roller 82 exposed to the outside of the housing 80.

A plurality (four in the embodiment) of rollers 86, 88, and 89 and a pressing member 87 are provided on the delivery path of the wiping member 30 from the delivery roller 81 to the winding roller 82 on the inside of the housing 80. These rollers 86, 88, and 89, and the pressing member 87 extend to the front and rear in parallel in to the delivery roller 81 and the winding roller 82, and both ends in the front-to-rear direction thereof are supported to freely rotate by a bearing or the like provided in the side wall portion of the housing 80.

Specifically, the part unreeled from the delivery roller 81 in the wiping member 30 is wound around the pressing member 87 provided obliquely upward to the right of the delivery roller 81. The shaft portions 87*a* on both sides in the axial direction in the pressing member 87 are supported from below by the rod spring 90 fixed to the outside surface on both sides to the front and rear of the housing 80. The rod spring 90 supports the shaft portion 87*a* of the pressing member 87 from below at an intermediate position in the length direction thereof. The shaft portions 87*a* of the pressing member 87 are inserted to the front and rear with respect to bearing holes 91 provided in the housing 80, and adhered to the hole edge on the upper side of the bearing hole 91 according to the upward biasing force acting from the rod spring 90. The shaft portions 87*a* of the pressing member 87 are supported to freely rotate from above and below between the rod spring 90 and the hole edge of the bearing hole 91. The uppermost portion of peripheral surface in the pressing member 87 is positioned further upward than the upper surface of the housing 80, and a part wound around the pressing member 87 in the wiping member 30 protrudes upward from the upper surface of the housing 80. The uppermost portion of the peripheral surface in the pressing member 87 is positioned further upward than the nozzle forming surface of the recording head 22.

It is possible for the driving mechanism of the embodiment including at least the rod spring 90 and the pressing member 87 to add a pressing load by pressing the wiping member 30 including the impregnating solution with respect to the nozzle forming surface 22 through the upward biasing force due to the rod spring 90. The pressing load in the embodiment indicates a spring load. As long as it is able to press the wiping member to the nozzle forming surface with a given fixed load, the mechanism that applies the pressing load is not necessarily a spring, and rubber may be used, or the load may be applied with a method such as applying a load by electrically controlling a mechanical member without using these.

A relay roller 89 around which a part reeled out from the pressing member 87 in the wiping member 30 is wound is provided vertically downward from the pressing member 87. A pinching roller 92 that pinches the wiping member 30 with the relay roller 89 is provided at a position that is the opposite side with respect to the relay roller 89 with the wiping member 30 interposed. The spring member 93 as a biasing member is interposed between the bottom wall inner surface of the housing 80 and the pinching roller 92. The pinching roller 92 is biased in a direction approaching the relay roller 89 by the spring member 93.

A relay gear 94 is provided to be able rotate integrally with the relay roller 89 at the end portion of the shaft portion 89*a* on one side (rearward side in FIGS. 4A and 4B) in the axial direction exposed to the outside from the side wall portion of the housing 80 in the relay roller 89. The end portions of the shaft portions 92*a* on both ends in the axial direction in the pinching roller 92 are exposed to the outside from a notched groove-shaped bearing portion formed when an elastic piece portion is notched in the side wall portion of the housing 80.

Tension rollers 86 and 88 that provide tension with respect to the wiping member 30 are provided between the delivery roller 81 and the pressing member 87 and between the pressing member 87 and the relay roller 89 on the delivery path of the wiping member 30 from the delivery roller 81 to the winding roller 82. The end portions of the shaft portions 86*a* and 88*a* on both sides in the axial direction in the tension rollers 86 and 88 are exposed to the outside from the circular concave bearing portion provided on the side wall portion of the housing 80.

The maintenance method according to the embodiment is also suitably used with respect to the ink jet recording apparatus that performs recording of images by heating the recording medium to 35° C. or higher (35° C. to 50° C. is preferable). Although nozzle clogging caused by heating easily occurs in such an ink jet recording apparatus, since the wiping step is performed using the impregnating solution described above in the cleaning method of the invention of the present application, it is possible to effectively suppress the occurrence of defects such as nozzle clogging.

2. EXAMPLES

Below, although specific description is given of the invention using examples and comparative examples, the invention is not limited to these examples alone.

2.1. Evaluation of Ink Composition

2.1.1. Preparation of Ink Composition

The inks were obtained by mixing and stirring each component so as to have the constitutions in Table 1, and filtering using a 5 μm membrane filter made from PTFE. Inks 1 to 4 and ink 6 are non-aqueous inks and ink 5 is an aqueous ink.

Among the components used in the table, those listed other than the compound names are as follows.

PB-15:3 (C.I. Pigment Blue 15:3)
GBL (γ-butyrolactone)
DEGBME (diethylene glycol butylmethyl ether)
DEGMEE (diethylene glycol methylethyl ether)
Naphtesol 160 (trade name, JX Nippon Oil & Energy Corporation, hydrocarbon based solvent)
TEGmBE (triethylene glycol monobutyl ether)
BKY-331 (trade name, manufactured by BYK-Chemie Japan Co., Ltd., silicon-based surfactant)
BKY-348 (trade name, manufactured by BYK-Chemie Japan Co., Ltd., silicon-based surfactant)
HM515 (trade name "Kanevinyl HM515", manufactured by Kaneka Corporation, vinyl chloride-vinyl acetate copolymer)
W-6061 (trade name "Takelac W-6061", manufactured by Mitsui Chemicals, Inc., urethane resin emulsion)

2.1.2. Preparation of Ink Composition

The evaluation testing of the ink composition used a modified ink jet printer "SC-S30650" (trade name) manufactured by Seiko Epson Corp. Installed in an environment testing chamber adjusted using an air conditioner and humidifier so that the temperature and the humidity of the environment testing chamber reach 25° C. and 65% RH respectively. Specifically, the head maintenance device 26 (refer to FIG. 1) was installed in the printer.

Each evaluation performed recording in heater heating conditions in which the surface temperature of the recording side of the recording medium becomes 35° C. using a heater provided in the platen of the printer. After recording, drying was performed at 25° C. after the recording material was discharged from the printer. The temperature and the humidity were measured using a temperature and humidity sensor installed on the housing not adversely influenced by the heating of the ink jet printer itself, such as a heater.

Printing Unevenness

After printing a solid pattern with a recording resolution of 720 dpi×720 dpi at 100% density on a vinyl chloride banner sheet (manufactured by 3M Limited, model number IJ51 (polyvinyl chloride)) with each ink using the printer, the medium was dried for 24 hours at 25° C. and 65% RH (relative humidity). Thereafter, the printing surfaces were observed visually and the evaluation results were classified according to the following evaluation criteria.

A: no printing unevenness

B: although no unevenness inside the pattern, unevenness occurs at end of pattern C: unevenness occurs inside the pattern Evaluation of Color Fastness to Rubbing After each ink was printed at density of 100% with a recording resolution of 720 dpi×720 dpi on a glossy polyvinyl chloride sheet (manufactured by Roland DG Corporation, model number SV-G-1270G) using the printer, the medium was dried for 1 day at 25° C. and 65% RH (relative humidity), thereby creating the recording material. Next, a dry test was performed using a type I tester based on JIS L 0849. Thereafter, the OD value of the examination cotton cloth was measured using a Spectrolino (manufactured by Gretag Macbeth Co., Ltd.), and the evaluation results were classified according to the following evaluation criteria.

A: 0.1 or less

B: more than 0.1 to 0.2

C: more than 0.2

Surface Drying Properties

After each ink was printed at a density of 100% with a recording resolution of 720 dpi×720 dpi on a glossy polyvinyl chloride sheet (manufactured by Roland DG Corporation, model number SV-G-1270G) using the printer, the discharge recording medium was dried for 5 minutes at 25° C. Next, scratching of the printing surface after being wound using the winding device was observed. The observation calculated the proportion of the area having scratching by measuring the surface roughness with a laser microscope (manufactured by Keyence Corporation, model number VK-8700 Generation 2). The evaluation criteria are as follows.

A: Scratching area is 10% or less of printing region

B: Scratching area is more than 10% to 20% of printing region

C: Scratching area is more than 20% of printing region

Fill

The obtained printing pattern was observed visually and with a microscope similarly to the "printing unevenness" above, and the evaluation results were classified according to the following evaluation criteria.

A: recording medium is completely covered by ink

B: recording medium appears covered visually; however, minor parts not covered when observed with a microscope C: parts where recording medium not covered able to be confirmed visually Waterproofness Printing pattern obtained similarly to the "printing unevenness" above rubbed 50 times back and forth with a swab including water, and damage to the printing pattern and color transfer confirmed visually. The evaluation criteria are as follows.

A: Neither damage nor color transfer confirmed

B: Although damage not confirmed, slight color transfer confirmed

C: damage confirmed 2.1.3. Evaluation Results of Ink Composition

The results of evaluation testing of ink composition are shown in Table 1.

TABLE 1

| | | Ink 1 | Ink 2 | Ink 3 | Ink 4 | Ink 5 | Ink 6 |
|---|---|---|---|---|---|---|---|
| Pigment | PB-15:3 | 4 | 4 | 4 | 4 | 4 | 4 |
| Organic Solvent | GBL | 20 | 0 | 72 | 15 | | 20 |
| | DEGBME | 48 | 48 | 10 | 5 | | 44 |
| | DEGMEE | 25 | 45 | 10 | 5 | | 25 |
| | Ethyl Lactate | | | | 34 | | |
| | Naphtesol 160 | | | | 34 | | |
| | TEGmBE | | | | | 20 | |
| | Glycerin | | | | | 20 | |
| | 2-pyrrolidone | | | | | 10 | |
| Surfactant | BYK 331 | 2 | 2 | 2 | 2 | | 2 |
| | BYK 348 | | | | | 2 | |
| Resin | HM515 | 1 | 1 | 2 | 1 | | 5 |
| | W-6061 | | | | | 1 | |
| Water | | | | | | 43 | |
| Total (mass %) | | 100 | 100 | 100 | 100 | 100 | 100 |
| Evaluation Results of Ink Composition | Printing Unevenness | A | B | A | A | C | A |
| | Color Fastness to Rubbing | B | C | A | B | C | A |
| | Surface Drying Properties | B | B | A | A | C | B |

TABLE 1-continued

| | Ink 1 | Ink 2 | Ink 3 | Ink 4 | Ink 5 | Ink 6 |
|---|---|---|---|---|---|---|
| Fill | B | A | B | C | B | B |
| Waterproofness | A | A | A | A | C | A |

As shown in Table 1, it is found that the non-aqueous inks (inks 1 to 4 and 6) are capable of recording favorable image on a recording medium with low ink absorbency (vinyl chloride) compared to the aqueous ink (ink 5).

2.2. Evaluation Relating to Wiping 2.2.1. Wiping Conditions

The evaluation relating to the wiping was performed according to the wiping conditions 1 to 18 shown in the following Table 2. A cellulose long fiber non-woven fabric (trade name Bemliese) was used as the "fabric", and impregnated with the impregnating solution. Meanwhile, a fluorine-based elastomer was used as the "rubber wiper". The wiping operation brings the wiping member (fabric or rubber wiper) into contact with nozzle plate (nozzle forming surface) and relatively moves the wiping member 20 cm in one direction with respect to the nozzle plate in a direction that intersects the direction nozzle rows in which the nozzles are lined up in a state of being pushed to the nozzle plate by the pushing member from the rear of the wiping member. The wiping member is formed in a roll shape, and a new part is unwound and used in the subsequent wiping.

TABLE 2

| Wiping Conditions | Impregnating Solution Constitution | Physical Properties of Impregnating Solution (Organic Solvent) Standard Boiling Point (° C.) | Vapor Pressure at 20° C. (hPa) | Amount of Impregnating Solution with respect to 100 parts by mass of Fabric | Wiping Method |
|---|---|---|---|---|---|
| 1 | triethylene glycol monobutyl ether 100 mass % | 271 | <0.01 | 20 parts by mass | Nozzle forming surface wiped with fabric in which impregnating solution held |
| 2 | tetraethylene glycol monobutyl ether 100 mass % | 290-310 | <0.01 | 20 parts by mass | Nozzle forming surface wiped with fabric in which impregnating solution held |
| 3 | pentaethylene glycol monobutylether 100 mass % | 290-310 | <0.01 | 20 parts by mass | Nozzle forming surface wiped with fabric in which impregnating solution held |
| 4 | ethylene glycol monophenyl ether 100 mass % | 245 | 0.01 | 20 parts by mass | Nozzle forming surface wiped with fabric in which impregnating solution held |
| 5 | diethylene glycol monobenzyl ether 100 mass % | 302 | <0.01 | 20 parts by mass | Nozzle forming surface wiped with fabric in which impregnating solution held |
| 6 | diethylene glycol diethyl ether 100 mass % | 189 | 0.5 | 20 parts by mass | Nozzle forming surface wiped with fabric in which impregnating solution held |
| 7 | diethylene glycol m ethyl ethyl ether 100 mass % | 176 | 0.9 | 20 parts by mass | Nozzle forming surface wiped with fabric in which impregnating solution held |
| 8 | dipropylene glycol monomethyl ether 100 mass % | 187 | 0.08 | 20 parts by mass | Nozzle forming surface wiped with fabric in which impregnating solution held |
| 9 | diethylene glycol monoethyl ether acetate 100 mass % | 217 | 0.07 | 20 parts by mass | Nozzle forming surface wiped with fabric in which impregnating solution held |
| 10 | 2-methyl glutarate dimethyl (dimethyl-2-methyl glutarate) 100 mass % | 222-224 | 0.06 | 20 parts by mass | Nozzle forming surface wiped with fabric in which impregnating solution held |
| 11 | diethylene glycol monobutyl ether 100 mass % | 230 | 0.01 | 20 parts by mass | Nozzle forming surface wiped with fabric in which impregnating solution held |
| 12 | tetraethylene mono butyl ether 100 mass % | 290-310 | <0.01 | 10 parts by mass | Nozzle forming surface wiped with fabric in which impregnating solution held |

TABLE 2-continued

| Wiping Conditions | Impregnating Solution Constitution | Physical Properties of Impregnating Solution (Organic Solvent) Standard Boiling Point (° C.) | Vapor Pressure at 20° C. (hPa) | Amount of Impregnating Solution with respect to 100 parts by mass of Fabric | Wiping Method |
|---|---|---|---|---|---|
| 13 | tetraethylene glycol monobutyl ether 100 mass % | 290-310 | <0.01 | 50 parts by mass | Nozzle forming surface wiped with fabric in which impregnating solution held |
| 14 | tetraethylene glycol monobutyl ether 100 mass % | 290-310 | <0.01 | 150 parts by mass | Nozzle forming surface wiped with fabric in which impregnating solution held |
| 15 | polyethylene glycol 100 mass % | 196 | 0.013 | 20 parts by mass | Nozzle forming surface wiped with fabric in which impregnating solution held |
| 16 | glycol 100 mass % | 393 | <0.01 | 20 parts by mass | Nozzle forming surface wiped with fabric in which impregnating solution held |
| 17 | tetraethylene glycol mono butyl ether 100 mass % | 290-310 | <0.01 | | After nozzle forming surface and rubber wiper sprayed with impregnating solution, nozzle forming surface wiped with rubber wiper |
| 18 | Not used | | | | impregnating solution not used, nozzle forming surface wiped with fabric (dry wiping) |

2.2.2. Evaluation Testing Relating to Wiping Cleaning Properties (Nozzle Forming Surface Cleaning Properties)

The inks were set in the printer and continuous printing was performed for 20 minutes. In the continuous printing, a platen heater was used so that the surface temperature of the recording medium became 45° C. when the ink is discharged. After printing, discharge inspection was performed, and the discharge of all nozzles (360 units) was confirmed. However, here, the occurrence of discharge bending and discharge amount anomalies were not factored in. "Discharge bending" refers to the landing position being separated from the normal landing position by a distance of ½ or more of the distance between the nozzles and the neighboring nozzle. "Discharge amount anomaly" refers to a difference of 20% or more with respect to the normal discharge amount.

Next, the wiping operation (wiping step) for wiping the nozzle forming surface was executed according to the wiping conditions shown in Tables 3 and 4. The discharge inspection was again performed, and the presence or absence of discharge defect nozzles with any of non-discharge, discharge bending, or discharge amount anomalies was confirmed. Although there were 0 non-discharge nozzles in the discharge inspection before the wiping operation for each example, 20 or fewer nozzles with flight bending or discharge amount anomalies were present. This is due to the influence of remaining ink attached to the periphery of the nozzle, and the wiping operation is necessary in order to prevent deterioration of the image quality.

The evaluation criteria are as follows.

A: No discharge defects after wiping operation

B: 1 to 5 discharge defect nozzles (however, no non-discharging nozzles) after wiping observation C: 6 or more discharge defect nozzles alternatively non-discharging nozzles Fabric Spreading Properties 3 μg ink droplets of each example were dropped on the fabric in the wiping conditions of each row, and the state of the spreading of the ink was confirmed after leaving for 10 minutes. The evaluation criteria are as follows.

A: wet spreading of the ink droplet has a diameter of 1.5 cm or more

B: wet spreading of the ink droplet has a diameter of more than 1.0 cm to 1.5 cm C: wet spreading of the ink droplet has a diameter of 1.0 cm or less Solvent Mixture (Aggregation)

The impregnating solution and ink used in each example were mixed and stirred at a mass ratio of 1:9 and sealed in a glass container, and the presence or absence of aggregation after being left for 1 day was visually confirmed.

A: No aggregation observed

B: Aggregation observed

Volatility (Solvent Residual Rate)

A fabric prepared in the wiping conditions of each example was placed in a Petri dish and left for 3 days in a 60° C. environment without being sealed. After being left, the residual rate of the solvent was confirmed. "Residual rate of solvent" refers to the proportion of the mass of impregnating solution remaining after being left with respect to the mass of the impregnating solution included in the fabric before being left.

A: Residual rate of 70% or more

B: Residual rate of more than 20% to 70%

C: Residual rate of 20% or less

Long Term Cleaning Properties

After performing testing of the nozzle forming surface cleaning properties, after performing 10 sets in which 20 minutes of continuous printing in the same the wiping operation and pausing the printer for one hour (head in a capped state) is one set, the discharge inspection was performed. The evaluation criteria are as follows.

A: No discharge defects after wiping operation

B: 1 to 5 discharge defect nozzles (however, no non-discharging nozzles) after wiping observation C: 6 or more discharge defect nozzles or non-discharging nozzles 2.2.3. Evaluation Results Relating to Wiping The evaluation results relating to the wiping are shown in Tables 3 and 4.

TABLE 3

| | | Example | | | | | | | | | | | | | | | | | | |
|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 |
| Conditions | Ink used | Ink 1 | Ink 1 | Ink 1 | Ink 1 | Ink 1 | Ink 1 | Ink 1 | Ink 1 | Ink 1 | Ink 1 | Ink 1 | Ink 1 | Ink 1 | Ink 1 | Ink 2 | Ink 3 | Ink 4 | Ink 6 | Ink 1 |
| | Wiping conditions | 1 | 2 | 3 | 4 | 5 | 6 | 7 | 8 | 9 | 10 | 11 | 12 | 13 | 14 | 2 | 2 | 2 | 2 | 12 |
| Wiping Testing Results | Cleaning Properties | A | A | A | A | A | A | A | A | A | A | A | B | A | B | B | B | B | B | A |
| | Fabric spreading properties | B | B | B | A | A | B | A | B | A | A | B | B | A | A | B | B | B | B | A |
| | Solvent mixture (aggregation) | A | A | A | A | A | A | A | A | A | A | A | A | A | A | A | A | B | A | A |
| | Volatility | A | A | A | C | B | C | C | C | C | C | C | A | A | A | A | A | A | A | A |
| | Long Term Cleaning properties | A | A | A | B | A | B | B | B | B | B | B | B | A | B | B | B | B | B | A |

TABLE 4

| | | Comparative Example | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Conditions | Ink used | Ink 1 | Ink 1 | Ink 1 | Ink 1 | Ink 5 | Ink 5 | Ink 5 | Ink 5 | Ink 5 | Ink 5 | Ink 5 | Ink 5 | Ink 5 | Ink 5 | Ink 5 | Ink 5 |
| | Wiping conditions | 15 | 16 | 17 | 18 | 1 | 3 | 4 | 5 | 6 | 7 | 8 | 15 | 16 | 17 | 18 | 2 |
| Wiping Testing Results | Cleaning Properties | C | C | C | C | C | C | C | C | C | C | C | A | C | C | C | C |
| | Fabric spreading properties | C | C | | | B | B | A | A | B | A | B | C | C | | | B |
| | Solvent mixture (aggregation) | B | B | | | B | B | B | B | B | B | B | A | A | | | B |
| | Volatility | A | A | | | A | A | A | A | A | A | A | A | A | | | A |
| | Long Term Cleaning properties | C | C | C | C | C | C | C | C | C | C | C | B | C | C | C | C |

As shown in Table 3, when cleaning of the nozzle forming surface is performed with the fabric in which the impregnating solution containing the specified organic solvent is held, it can be seen that the cleaning properties are excellent. The impregnating solution containing the specified organic solvent showed no aggregation of the non-aqueous ink.

Meanwhile, in Comparative Examples 1 and 2, because wiping is performed using the impregnating solution not containing the specified organic solvent, it can be seen that the cleaning properties are lowered.

In Comparative Examples 3 and 14, because wiping is performed using a rubber wiper, it can be seen that the cleaning properties are lowered. In Comparative Examples 4 and 15, because the impregnating solution was not used, it can be seen that the cleaning properties are lowered.

In Comparative Examples 5 to 11 and 16, because wiping is performed after the aqueous ink is used, it is found that an effect in which cleaning properties with the fabric in which the specified organic solvent is held are not improved.

In Comparative Example 12, wiping was performed with a fabric holding a solvent (polyethylene glycol) other than the specified organic solvent after using the aqueous ink. Although the impregnating solution of Comparative Example 12 indicates being suitable to cleaning with respect to the aqueous ink, as shown in the evaluation results of Comparative Example 1, the solution was determined to not be suitable to cleaning of non-aqueous ink.

In Comparative Example 13, wiping was performed with a fabric holding a solvent (glycol) other than the specified organic solvent after using the aqueous ink. According to the evaluation results of Comparative Example 2 and 12, it can be seen that the impregnating solution is not suitable to cleaning either of the aqueous and non-aqueous ink.

The invention is not limited to the embodiments described above, and various modifications thereof are possible. For example, the invention includes configurations which are substantially the same as the configurations described in the embodiments (for example, configurations having the same function, method and results, or configurations having the same purpose and effect). The invention includes configurations in which non-essential parts of the configurations described in the embodiments are replaced. The invention includes configurations exhibiting the same actions and effects as the configurations described in the embodiments or configurations capable of achieving the same object. The invention includes configurations in which known techniques are added to the configurations described in the embodiments.

The entire disclosure of Japanese Patent Application No.: 2014-099325, filed May 13, 2014 is expressly incorporated by reference herein.

What is claimed is:

1. A maintenance method of an ink jet recording apparatus that performs recording of images on a recording medium using a non-aqueous ink, wherein the ink jet recording apparatus includes a nozzle forming surface in which nozzles that discharge the non-aqueous ink are provided; and a wiping member with liquid absorbency, the method comprising:

wiping the nozzle forming surface with the wiping member using an impregnating solution, and wherein the impregnating solution contains at least one organic solvent selected from a group consisting of compounds represented by the following General Formula (I), esters, and dibasic acid esters, $$R^1—O—(R^2—O)_n—R^3 \quad (I)$$

(in General Formula (I) shown above, $R^1$ represents a hydrogen atom, an aryl group, or an alkyl group having 1 to 6 carbon atoms, $R^2$ represents an alkylene group having 2 to 4 carbon atoms, $R^3$ represents an aryl group or an alkyl group having 1 to 6 carbon atoms, and n represents an integer of 1 to 9).

2. The maintenance method of an ink jet recording apparatus according to claim 1, wherein the organic solvent included in the impregnating solution has a standard boiling point of 170° C. or higher.

3. An ink jet recording apparatus that performs maintenance with the maintenance method according to claim 2.

4. The maintenance method of an ink jet recording apparatus according to claim 1, wherein the non-aqueous ink includes a glycol ether as the organic solvent, and the content of the glycol ether is 20 mass % or more with respect to the total mass of the non-aqueous ink.

5. An ink jet recording apparatus that performs maintenance with the maintenance method according to claim 4.

6. The maintenance method of an ink jet recording apparatus according to claim 1, wherein the wiping is performed by the impregnating solution being held in the wiping member, and 20 parts by mass or more of the organic solvent is included in the impregnating solution held in the wiping member, with respect to 100 parts by mass of the wiping member.

7. An ink jet recording apparatus that performs maintenance with the maintenance method according to claim 6.

8. The maintenance method of an ink jet recording apparatus according to claim 1, wherein the wiping member is a fabric.

9. An ink jet recording apparatus that performs maintenance with the maintenance method according to claim 8.

10. The maintenance method of an ink jet recording apparatus according to claim 1, wherein the non-aqueous ink includes a lactone as an organic solvent.

11. An ink jet recording apparatus that performs maintenance with the maintenance method according to claim 10.

12. The maintenance method of an ink jet recording apparatus according to claim 1, wherein the wiping member holds the impregnating solution during shipping.

13. An ink jet recording apparatus that performs maintenance with the maintenance method according to claim 12.

14. The maintenance method of an ink jet recording apparatus according to claim 1, wherein the non-aqueous ink includes a contains a fixing resin.

15. An ink jet recording apparatus that performs maintenance with the maintenance method according to claim 14.

16. The maintenance method of an ink jet recording apparatus according to claim 1, wherein the recording medium is heated to 35° C. or higher, and used in the ink jet recording apparatus that performs recording of images.

17. An ink jet recording apparatus that performs maintenance with the maintenance method according to claim 16.

18. An ink jet recording apparatus that performs maintenance with the maintenance method according to claim 1.

* * * * *